US007108290B2

(12) United States Patent
Nansen et al.

(10) Patent No.: US 7,108,290 B2
(45) Date of Patent: Sep. 19, 2006

(54) CORRUGATED WEB HOLE REINFORCEMENT

(75) Inventors: David S. Nansen, Bellevue, WA (US); Paul S. Gregg, Seattle, WA (US); Marc R. Matsen, Seattle, WA (US); John J. Gurbach, R.S.M., CA (US); Soo Y. Oh, Irvine, CA (US)

(73) Assignee: The Boeing Company, Chicago, IL (US)

( * ) Notice: Subject to any disclaimer, the term of this patent is extended or adjusted under 35 U.S.C. 154(b) by 179 days.

(21) Appl. No.: 10/610,344

(22) Filed: Jun. 30, 2003

(65) Prior Publication Data

US 2004/0262914 A1 Dec. 30, 2004

(51) Int. Cl.
*F16L 5/00* (2006.01)

(52) U.S. Cl. ..... 285/139.1; 285/139.3

(58) Field of Classification Search ..... 285/136.1, 285/139.1, 139.3, 141.1, 205
See application file for complete search history.

(56) References Cited

U.S. PATENT DOCUMENTS

| | | | | |
|---|---|---|---|---|
| 4,437,687 | A * | 3/1984 | Wilson | 285/136.1 |
| 4,619,471 | A * | 10/1986 | Harbeke | 285/136.1 |
| 5,293,724 | A * | 3/1994 | Cornwall | 285/139.1 |
| 6,314,962 | B1 * | 11/2001 | Vaska et al. | 128/898 |
| 6,550,816 | B1 * | 4/2003 | Sorkin | 285/139.1 |
| 6,895,894 | B1 * | 5/2005 | Fort, II | 119/57.8 |

* cited by examiner

*Primary Examiner*—David Bochna
(74) *Attorney, Agent, or Firm*—Lee & Hayes, PLLC

(57) ABSTRACT

A device is provided for reinforcing a penetration in corrugated material having a plurality of corrugations. The device includes a tube configured to be received within the penetration. A first holder is attached to the tube, and the first holder has at least one finger arranged to engage at least one corrugation in the corrugated material. If desired, a second holder may be arranged to also engage at least one corrugation.

27 Claims, 6 Drawing Sheets

14
11
10
12
13
15
11
10
12
α
11
17
18
β
11
℄

16
13
β
11
10
22
12
22
11
12
15
10
11
17
22
19
18
11
22
℄

CORRUGATED WEB HOLE REINFORCEMENT

FIELD OF THE INVENTION.

This invention relates generally to structural reinforcements and, more specifically, to reinforcement of penetrations in beam webs.

BACKGROUND OF THE INVENTION

With modern materials and advanced fabrication methods, the use of corrugated materials in structures, mechanical devices and vehicles including aircraft is increasing. Corrugated shear webs, including "sine wave or arc-wave" webs in spars or beams have structural benefits over flat webs. Corrugated shear webs are naturally more stable and do not attract beam bending loads like a flat web. Weight savings by utilizing corrugated shear webs can range from 40 percent to 70 percent, depending upon the degree of post-buckling allowed in a flat web.

Corrugated materials in structures, devices, and vehicles commonly have penetrations. These penetrations typically allow electrical and hydraulic cables and lines to pass through. FIG. 1 is an example beam 2 with a corrugated web 4 and caps 5. To retain structural integrity of the web 4 when a penetration 7 is required, it is common to install a flat section of web, often called a 'flat' 6, within the corrugated web 4, and then install the penetration 7 in the flat 6. The flat 6 is a flat section of web without corrugations. A reinforcing ring or boss 8 is often installed and attached to the flat 6 surrounding the edges of the penetration 7, thereby reinforcing the flat 6 around the penetration 7. Typically, a flat 6 has a greater thickness, and thus a greater weight per area, than the balance of the corrugated web 4.

Prior art corrugated webs include arc webs such as the arc web 14 shown in cross-section in FIG. 2A and arc-flat webs such as the arc-flat web 16 shown in cross-section in FIG. 2B. Referring now to FIG. 2A, the arc web 14 is a linked series of alternating arcs 11 that alternate across a center plane 13. Each arc segment 11 creates a valley 12 on the concave side of the arc 11 and a peak 10 on the convex side of the arc 11. It will be appreciated that a valley 12 on one side of the web 14 is a peak 10 when viewed from the opposite side of the web 14. In this suitable example web 14, the arcs 11 have a radius 15 of 0.750 inches, and a wavelength 17 of 2.598 inches. The arcs 11 in this example transcend an arc-angle $\alpha$ of 120 degrees, and the interlocking arcs 11 cross the centerline or center plane 13 at an inclination angle $\beta$ of 60 degrees. This exemplary arc web has an amplitude 18 of 0.75 inches.

Corrugated structural materials used for corrugated webs suitably include metals, plastics, and composite materials. In aircraft, aluminum, titanium, and fiber composite corrugated webs have been utilized.

Referring now to FIG. 2B, an arc-flat web 16 includes an alternating series of arcs 11 and straight sections 22. The straight sections 22 cross the center plane 13 at their center at an inclination of 30 degrees. Arcs 11 are alternated between planar straight sections resulting in corrugations. As in FIG. 2A, the arcs 11 result in valleys 12 at the concave side of the arcs and peaks 10, at the convex side of the arcs. In this example, the arcs 15 have a radius of 0.280 inches and the straight sections 22 between the arcs have a length of 1.120 inches. The amplitude 18 of this exemplary corrugated web is 0.635 inches centered along the center plane 13.

It will be appreciated that manufacturing a beam or other structure with a corrugated web becomes more involved when a flat, such as the flat 6 (FIG. 1), is required to be incorporated parallel to the center plane of the web to provide a reinforced landing or space for a penetration. The corrugated web may be severed and the flat attached in between corrugated sections when the beam or structure is assembled. In an arc-flat web, such as the arc-flat web 16 (FIG. 2B), for larger penetrations, it will be appreciated that an inserted flat is often substantially longer than a straight section 22. Therefore, a straight section 22 alone does not form a large enough flat to encompass the desired size penetration. Put somewhat differently, for larger penetrations, flats for penetrations often are wider than the wavelength of the corrugations, precluding the use of a part of a wavelength of a corrugation as a flat or essentially flat area to locate a penetration.

It will also be appreciated that incorporating a corrugated web with an installed flat into a beam typically includes additional or more involved fabrication steps, as compared to incorporating a continuous and uniform corrugated web in a beam. Attachment of a web with a flat to the beam caps or flanges, such as the caps 5 in the beam 2 (FIG. 1), includes transitioning the machinery or forms used to attach the webs to the caps from alternating along the corrugation to proceeding along the straight edge of the flat, and then back to alternating along the corrugation. These efforts are time-and-labor intensive and, as a result, expensive.

Therefore, an unmet need exists for improved devices and methods for reinforcing corrugated materials at penetrations.

SUMMARY OF THE INVENTION

The present invention presents a lightweight and convenient to install device and method for reinforcing corrugated materials.

An embodiment of the present invention provides a device for reinforcing a penetration in corrugated material having a plurality of corrugations. The device includes a tube configured to be received within the penetration. A first holder is attached to the tube, and the first holder has at least one finger arranged to engage at least one corrugation in the corrugated material. If desired, a second holder may be arranged to also engage at least one corrugation.

Further embodiments of the invention provide a device including a tube and two retainers configured to receive ends of the tube. The two retainers sandwich a corrugated web between them. Accordingly, the invention thus provides a method of reinforcing corrugated materials.

Another exemplary method of the present invention may also be utilized to repair damage to corrugated materials. Repairs may be made by cutting a new penetration around a damaged area and then installing a device of the present invention, thereby sandwiching the corrugated web around the new penetration.

Another embodiment of the invention includes a tube configured to be received within the penetration, with or without supporting flanges on the ends of the tube.

BRIEF DESCRIPTION OF THE DRAWINGS

The preferred and alternative embodiments of the present invention are described in detail below with reference to the following drawings.

DETAILED DESCRIPTION OF THE INVENTION

The present invention presents a lightweight and convenient to install device for reinforcing corrugated materials. By way of overview, an embodiment of the present invention provides a device for reinforcing a penetration in corrugated material having a plurality of corrugations. The device includes a tube configured to be received within the penetration. A first holder is attached to the tube, and the first holder has at least one finger arranged to engage at least one corrugation in the corrugated material. If desired, a second holder may be arranged to also engage at least one corrugation.

Further embodiments of the invention provide a device including a tube and two retainers configured to receive ends of the tube. The two retainers sandwich a corrugated web between them. Accordingly, the invention thus provides a method of reinforcing corrugated materials.

Figure 1:
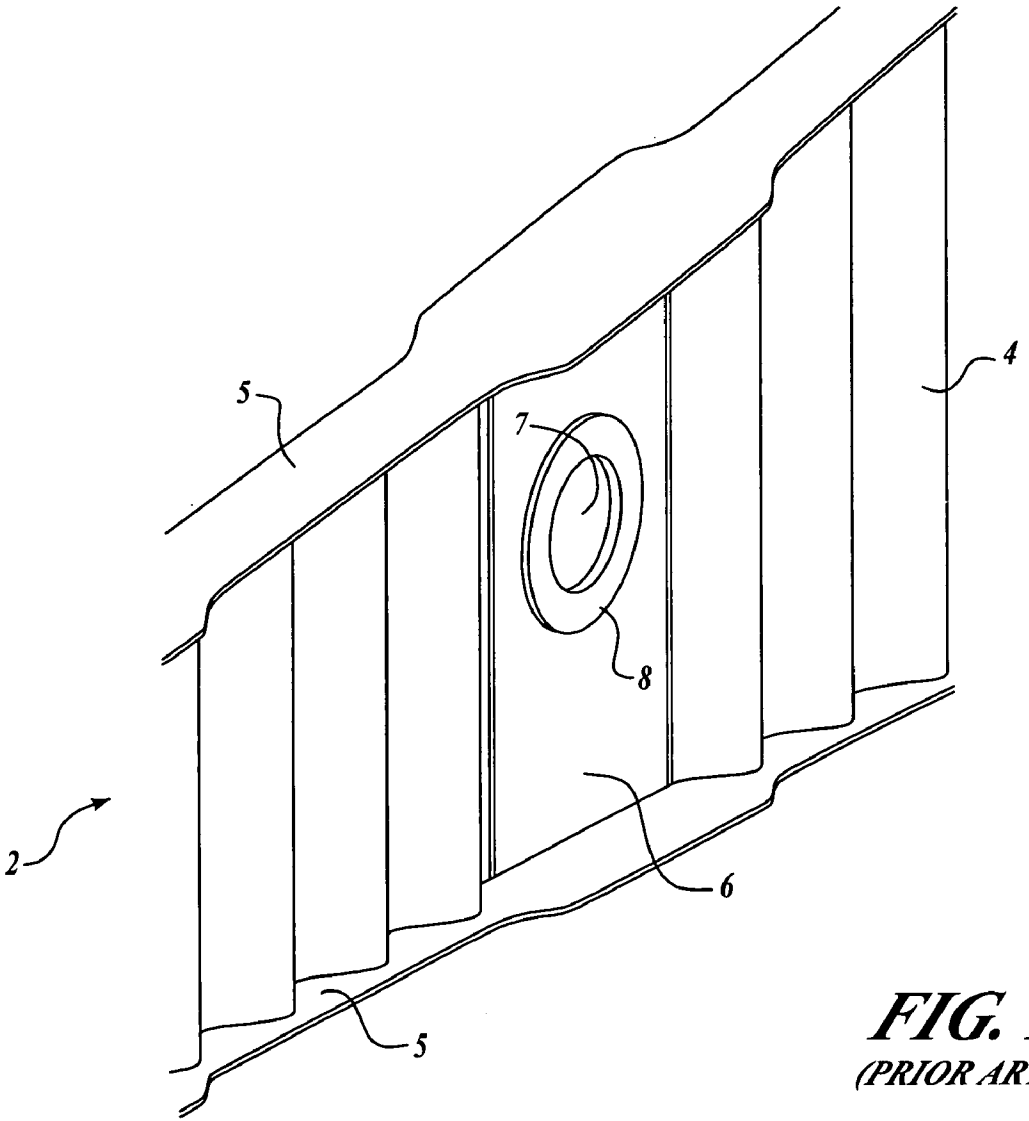
FIG. 1 (PRIOR ART)
FIG. 1 is an isometric view of a prior art corrugated web beam with a penetration.
Figure 2A:
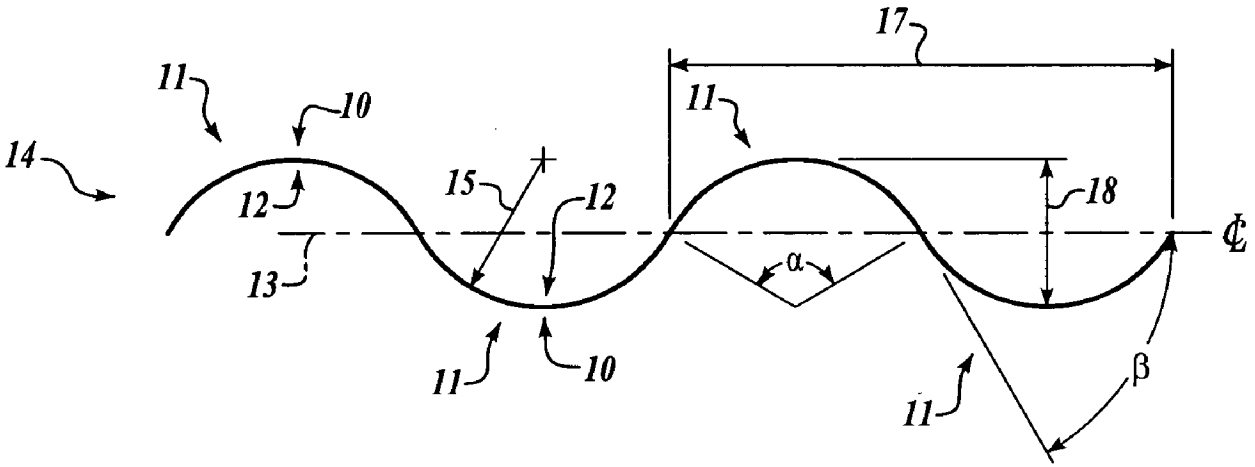
FIG. 2A (PRIOR ART)
FIG. 2A is a cross-section of a prior art arc web.
Figure 2B:
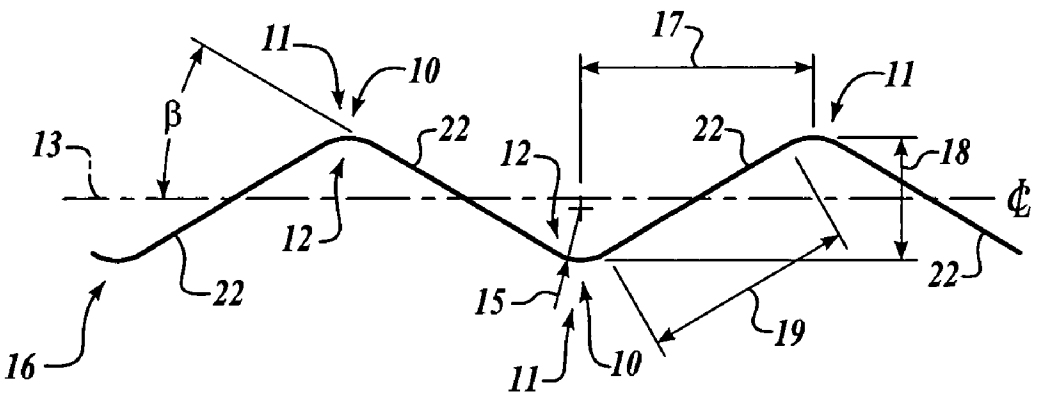
FIG. 2B (PRIOR ART)
FIG. 2B is a cross-section of a prior art arc-flat web.
Figure 3A:
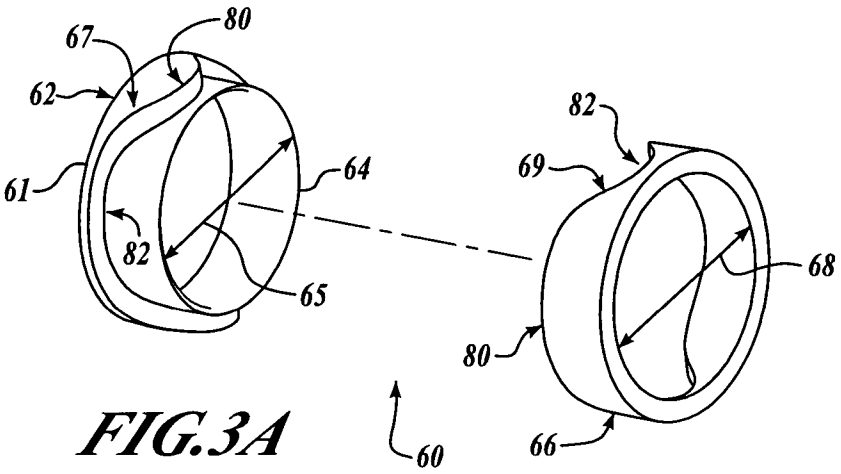
FIG. 3A is an isometric exploded view of an exemplary two-part web reinforcement device according to an embodiment of the present invention.

FIG. 3A is an exploded isometric view of an exemplary two-part web reinforcement device 60 according to one embodiment of the present invention. The device 60 includes a tube 64. In this example, the tube 64 is cylindrical with an outside tube diameter 65. The diameter 65 is sized to be received within a penetration in a corrugated material (not shown). The tube 64 is attached to a first holder 61. In this embodiment, by way of example but not limitation, the first holder 61 surrounds the tube 64 on an end 62 of the tube 64. The first holder 61 in this suitable embodiment has a larger diameter than the tube diameter 65. The holder 61 thus may engage corrugations or portions of a corrugation in a corrugated material when the tube 64 is inserted into a penetration in the corrugated material (not shown). In this example, the penetration (not shown) has an inside diameter corresponding to the outside diameter 65 of the tube 64. The diameter of the first holder 61 thus exceeds the diameter of the penetration (not shown.)

The first holder 61 defines at least one finger 80 that engages corrugations in the corrugated material. In this example the finger 80 engages the valley of a corrugation (not shown). The holder also defines an indent 82 that suitably may engage a peak (not shown) in a corrugated material. It will be appreciated that when the tube 64 is inserted into the penetration, the first holder 61, having a larger diameter than the penetration, may suitably include a plurality of fingers 80 and indents 82 around the first holder 61. These fingers 80 and indents 82 are contoured to match the peaks and valleys of the corrugated material (not shown) at the location of the penetration. In this embodiment, the fingers 80 and indents 82 are linked in a continuous first contour 67. The first contour 67, by way of example but not limitation, corresponds to the peaks and valleys of the corrugations at the penetration, with the fingers 80 engaging valleys in the corrugations and the indents 82 engaging peaks in the corrugations. Thus, the first contour 67 of the holder 62 is in continuous contact with, and can support, the corrugated material around the perimeter of the penetration (not shown) when the tube 64 with the attached holder 62 is inserted through the penetration until the holder 62 abuts one side of the corrugated material.

It will be appreciated that if the diameter of the penetration (not shown) is less than one full wavelength of a corrugation of the corrugated material (not shown), and continuous contact of the first contour 67 with the fingers 80 and indents 82 with the corrugated material is desired, the first holder 61 may include only one finger 80 and one indent 82. Alternately, the holder 61 may include more than one finger 80 and more than one indent 82, depending on where the penetration occurs in the phase of the corrugation, once the device is installed. It will further be appreciated that if the penetration, and hence the tube diameter 64, exceeds a full wavelength of the corrugations of the corrugated material (not shown), the first holder 61 will have a multitude of fingers 80 and indents 82 corresponding with valleys and peaks in the corrugated material on the side of the corrugated material where the holder 61 is placed. This occurs where it is desired to completely and continuously engage the corrugated material around the periphery of the penetration.

In this example, the first holder 61 is suitably molded together with the tube 64 in one unit, forming a unitized insert 62. By way of example but not limitation, for reinforcing aluminum corrugated materials, the tube 64 and first holder 61 may suitably be manufactured of aluminum as well. Similarly, a titanium tube 64 and first holder 61, by way of example but not limitation, may suitably be utilized with titanium corrugated materials. By way of example but not limitation, fiber composite tubes 64 and holders 61 suitably may be utilized to reinforce penetrations in composite corrugated materials. It will be appreciated that the listed materials are exemplary, and that other materials may be utilized to reinforce a variety of corrugated materials.

By way of example but not limitation, titanium or aluminum tube 64 and holders 61 may be cast or machined, while fiber composite tube 64 and holders 61 may be molded from chopped fiber and resin. It will be appreciated that the first holder 61 in this embodiment is shaped with a continuous and smooth first contour 67 between the finger 80 and the indent 82 that engages the corrugated material when the tube is inserted into a penetration (not shown). It will be appreciated that fingers 80 and indents 82 may be discrete and separated, and the holder, by way of example, may not continuously engage the corrugated material between a finger 80 and an indent 82. At the same time, it will be appreciated that a smooth first contour 67 spanning between the fingers 80 and an indents 82, with the first contour 67 corresponding to a part of a corrugation or one or more corrugations, permits the corrugated material to be engaged and supported continuously by the first holder 61 around all of the penetration. It will be appreciated that continuously engaging the corrugated material around the perimeter of the penetration with the first holder 61 permits the corrugated material to be continuously sandwiched between the first holder 61 and a second holder or retainer 66 on the opposite side of the corrugated material. This supports the corrugated web around the perimeter of the penetration against buckling over the entire circumference of the penetration.

It will be appreciated that in the embodiment shown in FIG. 3A the tube 64 is cylindrical. While a circular penetration has certain advantages in uniformly distributing loads, other cross-sectional shapes of the tube may be utilized, corresponding to any desired shape of a penetration in the corrugated material (not shown).

It will be appreciated that the tube 64 and first holder 61 of FIG. 3A may be installed in a corrugated material by inserting the tube 64 and attached first holder 61 from one side of the corrugated material until the first holder 61, with its fingers 80 and indents 82, rests up against and supports one side of the corrugated material (not shown). The tube 64 and/or the holder 61 may then be attached to the corrugated web, thereby providing further support to the corrugated material. By way of example but not limitation, the tube 64 and holder 61 may be attached to the corrugated material suitably utilizing welding, brazing, or adhesive depending upon the materials utilized for the corrugated material and the first holder 61 and tube 64. The tube 64 may be suitably sized or configured to form an interference fit or thermal bond attachment between the corrugated web and tube 64. By cooling the tube 64 and/or heating the web when the tube 64 is inserted in the web, when the web and tube 64 are returned to an ambient temperature, the tube 64 suitably tightly attaches to the corrugated web.

FIG. 3A also shows a second holder 66 configured to engage the opposite side of the corrugated material from the first holder 61. In this example, the second holder 66 is in the form of a tube with an inside diameter 68 that may slip over the tube 64 when the tube 64 projects through a penetration in a corrugated material. The second holder 66 also defines at least one finger 80 configured to engage a corrugation in the corrugated material. In this embodiment the second holder has a plurality of fingers 80 and indents 82 defined by a second contour 69. In this embodiment, by way of example, but not limitation, the second contour 69 is a smooth curve linking alternating fingers 80 and indents 82 in a continuous curve around the perimeter of the second holder 66. The second contour 69 in this example embodiment is configured to continuously engage valleys and peaks in a corrugated material on the opposite side of the corrugated material from the tube 64 and first holder 61 when the tube 64 is received by the corrugated material and projects through the corrugated material.

It will be appreciated that the second holder 66 may be fabricated of the same materials as the tube 64 and first holder 61, or may be any material that suitably may be attached to the tube 64 or the corrugated material (not shown). In the embodiment shown in FIG. 3A, the second holder 66 is suitably a segment of cylindrical tube with an inside diameter 68 that matches the diameter 65 of the tube 64 so that the second holder 66 smoothly fits over and surrounds the tube 64. The tube 64 fits concentrically inside the second holder 66. As is shown in further detail in FIG. 4, the second holder 66 may then be slid over the tube 64 until the fingers 80 and indents 82 of the second holder 66 engage corrugations in the corrugated material, sandwiching them between the first holder 61 and the second holder 66, supporting the corrugated material from buckling around the penetration.

The exemplary embodiment shown in FIG. 3A is manufactured to include two parts. The tube 64 is one part that is attached to the first holder 61 inserted from one side of the corrugated material through a penetration (not shown). A second part is the second holder 66 that slides over the tube 64 projecting through the penetration on the opposite side of the corrugated material. In this exemplary embodiment, the first contour 67 that defines the fingers 80 and indents 82 of the first holder 61 is oppositely phased from the second contour 69 that defines the fingers 80 and indents 82 of the second holder 66. In this example configuration, being oppositely phased means fingers 80 in the first holder 61 correspond with indents 82 in the second holder 66, and fingers 80 in the second holder 66 correspond with indents 82 in the first holder 61. It will be appreciated that this occurs because a valley on one side of a corrugated material is a peak on the opposite side of the material. In this embodiment, fingers 80 of the first holder 61 and the second holder 66 engage valleys in their respective sides of the corrugated material, while indents 82 engage peaks in their respective sides of the corrugated material. It can be appreciated that the number of fingers 80 and indents 82 in the first holder 61 and/or in the second holder 66 may be varied, and may not necessarily be of the same shape. This depends, for example, upon the method of attachment to the corrugated web, and the degree and areas of support for the corrugated web desired to be achieved. For example, if spot welding is utilized to connect either the first or the second holder to the corrugated web, discontinuities in the first contour 67 or second contour 69 such as spaces between the fingers 80 and indents 82 or even skipped fingers 80 and indents 82 may be desired to provide access for welding. In the embodiment shown in FIG. 3A, the first holder 61 and the second holder 66 completely and continuously engage and support their respective sides of the corrugated material around the circumference of the penetration (not shown), while the inside of the penetration is supported along its interior edge (not shown) by the tube 64, which projects through the penetration.

It will be appreciated that the second holder 66 may be attached to the corrugated material and/or the tube 64 projecting through the penetration, depending upon the materials and attachments utilized and the degree of support for the corrugated materials desired. By way of example but not limitation, typically in metallic materials, a second holder 66 may be attached to a tube 64 projecting through a penetration (not shown) by first cooling the tube, and simultaneously heating the second holder 66. If the second holder 66 has an inside diameter 68 that matches an outside diameter 65 of the tube 64, the second holder 66 may be slipped over the tube 64. When the tube 64 is inserted through a penetration until the first holder 61 rests against a first side of the corrugated material, when the second holder 66 and the tube 64 return to an ambient temperature, the second holder 66 and the tube 64 will become attached. The second holder 66 will contract as it cools, and the tube 64 will expands as it warms, thereby forming a tight friction attachment, or thermal bond. Alternately, by way of example and not limitation, where a metallic tube 64 is utilized and the second holder 66 is also made of metal, the tube 64 and the second holder 66 may be welded together or brazed together, holding the first holder 61 attached to the tube 64 on one side of the corrugated material, and holding the second holder 66 on the opposite side of the corrugated material, with the corrugated material sandwiched between the two holders 61 and 66. Similarly, if the first holder is metallic and the corrugated web is metallic, the first holder 61 suitably may be brazed or welded to the corrugated web, with or without the use of a second holder 66. On the opposite side of the corrugated web, a metallic second holder 66 may similarly be welded or brazed to the corrugated material. It will be appreciated that when the first holder 61 with its fingers 80 and indents 82 engages the corrugated material around the penetration at the locations that are engaged by the fingers 80 and indents 82 of the second holder 66 that the corrugated web receives support against buckling from both sides at those locations. This suitably occurs when the first holder 61, attached to the tube 64, is held tightly to the first side of the corrugated material (not shown), and the second holder 66, also attached to the tube 64, is tightly held in contact with the opposite side of the corrugated material. Thus, even without any further attachment such as welding, brazing or adhesive between the first holder 61 and the corrugated material, or between the second holder 66 and the corrugated material, the tube 64 sandwiches the corrugated web between the two holders 61 and 66, thereby reinforcing the corrugated web around the perimeter of the penetration. It will be appreciated that a further variety of attachments may be utilized to attach the second holder 66 to the tube 64 projecting through the corrugated material, including pins, bolts, or adhesives.

It will be appreciated that if the tube 64 and first holder 61 are manufactured of a fiber composite material, such as, by way of example but not limitation, carbon fiber resin composite material, a second holder 66 manufactured of the same material may be bonded to the tube 64 with a suitable adhesive where the tube 64 projects through the penetration. It will be appreciated that the outside surface of tube 64 projecting through the penetration (not shown) provides a suitable surface area for adhering the second holder 66 to the tube 64 when the second holder 66 concentrically overlaps and slides over the tube 64.

While the two-part web reinforcement device 60 of FIG. 3A supports both sides of a corrugated material, it will be appreciated that the tube 64 and the attached first holder 61 may be utilized to reinforce a penetration in corrugated material from one side, when a second holder such as second holder 66 is not utilized.

It will also be appreciated that the tube 64 may be discontinuous or segmented, where, by way of example but not limitation, the penetration sought to be reinforced rests against an obstruction, or where some segments of the tube are first attached to a second holder 66 and inserted from an opposite side of the corrugated material.

It will further be appreciated that the tube 64 may be used to reinforce a penetration in a corrugated material without any holder, if the tube alone provides sufficient reinforcement to the inside edge of the penetration. It will be appreciated that if the tube 64 is adhered or attached to corrugated material at the penetration, the corrugated material is prevented from moving laterally, and the corrugated material receives further support against buckling when under stress. Such an attachment, by way of example, but not limitation, may include an interference fit or thermal bond as described above.

Figure 3B:
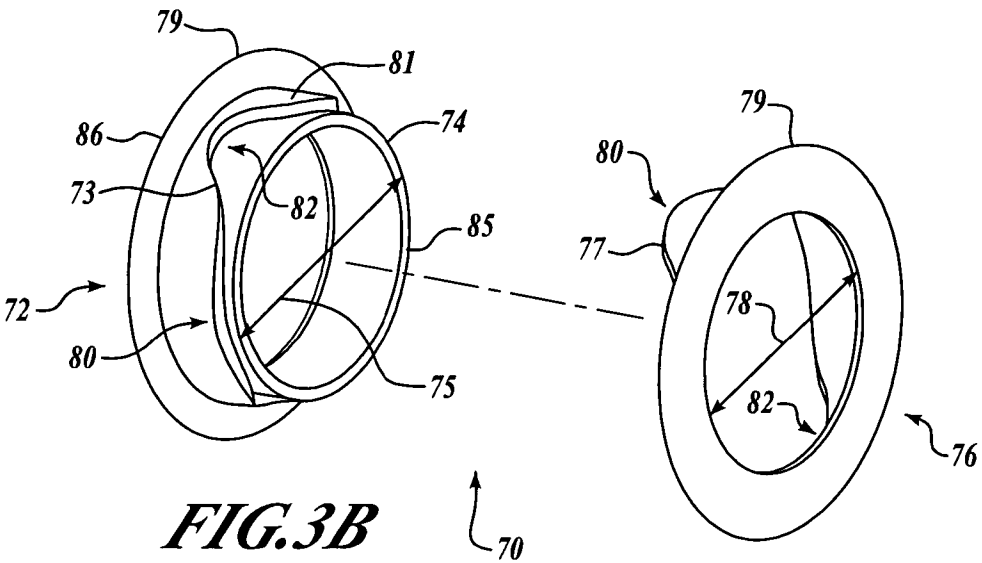
FIG. 3B is an isometric exploded view of an exemplary two-part web reinforcement device with reinforcing flanges according to an embodiment of the present invention.

A tube received by a penetration and its attached holder such as the tube 64 and holder 66 in FIG. 3A may also be reinforced across their diameter. FIG. 3B is an exploded isometric view of an exemplary two-part web reinforcement device 70 with reinforcing flanges 79. This exemplary embodiment also includes a tube 74 with an attached holder 81. The tube 74 is a cylindrical tube with an outside diameter 75 corresponding with a penetration in a corrugated material (not shown). The holder 81 surrounds an end of the tube 74. The holder 81 engages corrugations in the corrugated material when the opposite end of the tube 74 is inserted through a penetration in the corrugated material, in the same manner as the first holder 61 of FIG. 3A. The first holder 81 has at least one finger 80 that engages a part of a corrugation in the corrugated material, typically a valley in the corrugated material. The holder 81 is attached to the tube 74. In this exemplary embodiment the first holder 81 also has at least one indent 82, which in this exemplary embodiment engages a peak in the corrugated material. In this embodiment, the first holder 81 defines a contour 73 between and including two fingers 80 and two valleys 82 (one each shown).

In this exemplary embodiment, the first contour 73 corresponds with the corrugations on one side of the corrugated material surrounding a penetration. Thus, when the tube 74 is inserted through a penetration of corrugated material, the holder 81 surrounding the outside of the tube 74 on a first end 86 engages the corrugations in the corrugated material, while the opposite end 85 of the tube 74 projects through the penetration. With the contour 73 corresponding with the corrugations (or in other applications a part of a single corrugation) in the corrugated material, the corrugated material is continuously engaged and supported by the first holder 81 around the perimeter of the penetration. In this embodiment the tube 74 and the holder 81 are reinforced by a flange 79. The flange 79 is attached to the first holder 81 and the tube 74 at the first end 86 of the tube 74. The flange 79 reinforces the tube 74 and the first holder 81 across their diameter, adding structural rigidity to the tube and the holder across their diameter, which in this embodiment is a circular section. Thus, in this exemplary embodiment, the flange 79 is suitably a flat ring manufactured with, or bonded to, the tube 74 and the first holder 81 at the first end 86. It will be appreciated that the flange 79 may be attached to the tube 74 and the holder 81 at a location other than the first end 86 of the tube 74. It will also be appreciated that the flange 79 may be of any suitable shape or configuration to reinforce the tube 74 and/or the first holder 81 across their diameter. The flange 79, tube 74, and first holder 81, may be manufactured as a single unit or assembled into a unitized one-piece insert 72.

It can be appreciated that the flange 79, tube 74 and the first holder 81 can be utilized to reinforce a penetration of corrugated material from a single side, without a second holder or retainer. In such an embodiment, the first holder 81 would support the corrugated web from one side of the corrugated material, with the tube 74 projecting through the penetration supporting the inside perimeter of the corrugated material at the penetration.

In the embodiment shown in FIG. 3B, the tube 74 and first holder 81 are suitably utilized in conjunction with a second holder 76 with an inside diameter 78 corresponding to the outside diameter 75 of the tube 74. This permits the second holder 76 to slip over and be attached to the tube 74 when the opposite end 85 of the tube 74 projects through a penetration in the corrugated material. As in FIG. 3A, the second holder 76 in this exemplary embodiment includes at least one finger 80, in this example configured to engage a valley at the opposite side of the corrugated material from the first holder 81. In this exemplary embodiment the second holder 76 also defines at least one indent 82 corresponding with a peak in the opposite side of the corrugated web from the first holder 81.

The second holder 76 has a second contour 77 defining and linking the finger 80 and the indent 82 in a curve corresponding to the shape of the corrugated material on the opposite side of the corrugated material at the penetration from the first holder 81. It will be appreciated that in this embodiment the first contour 77 is the reverse of, or opposite phase of, the first contour 73 of the first holder. This allows the first holder 81 and the second holder 76 to sandwich corrugations in the corrugated web at the penetration between them when the second holder 76 is attached to an opposite end 85 of the tube 74 where the tube 74 projects through the penetration in the corrugated material.

In this embodiment, the second holder 76 also includes a reinforcing flange 79. In this embodiment, the flange 79, by way of example but not limitation, is in the form of a flat ring for reinforcing the second holder across its diameter, in this example a circular section with an inside diameter 78 matching the outside diameter 75 of the tube 74. It will be appreciated that when the tube 74 is slipped through a penetration in a corrugated material, the second holder 76 may be slipped over and attached to the tube 74, with the result that the first holder 81 and the second holder 76 tightly sandwich the corrugated web around the perimeter of the penetration. This reinforces the corrugated material against buckling or deformation. The two reinforcing flanges 79, one attached to the tube 74 and first holder 81 on one side of the corrugated material, and second attached to the second holder 76 on the opposite side of the corrugated material resist deformation of the first holder 81 and tube 74, and second holder 76, further reinforcing the corrugated material in the area of the penetration.

It will further be appreciated that the tube 74 with one or more attached flanges 79 may be used to reinforce a penetration in a corrugated material without any holder if the tube with flange(s) alone provide sufficient reinforcement to the inside edge of the penetration. It will be appreciated that if the tube 74 is adhered or attached to corrugated material at the penetration, the corrugated material is prevented from moving laterally, and the corrugated material receives further support against buckling when under stress.

Figure 4:
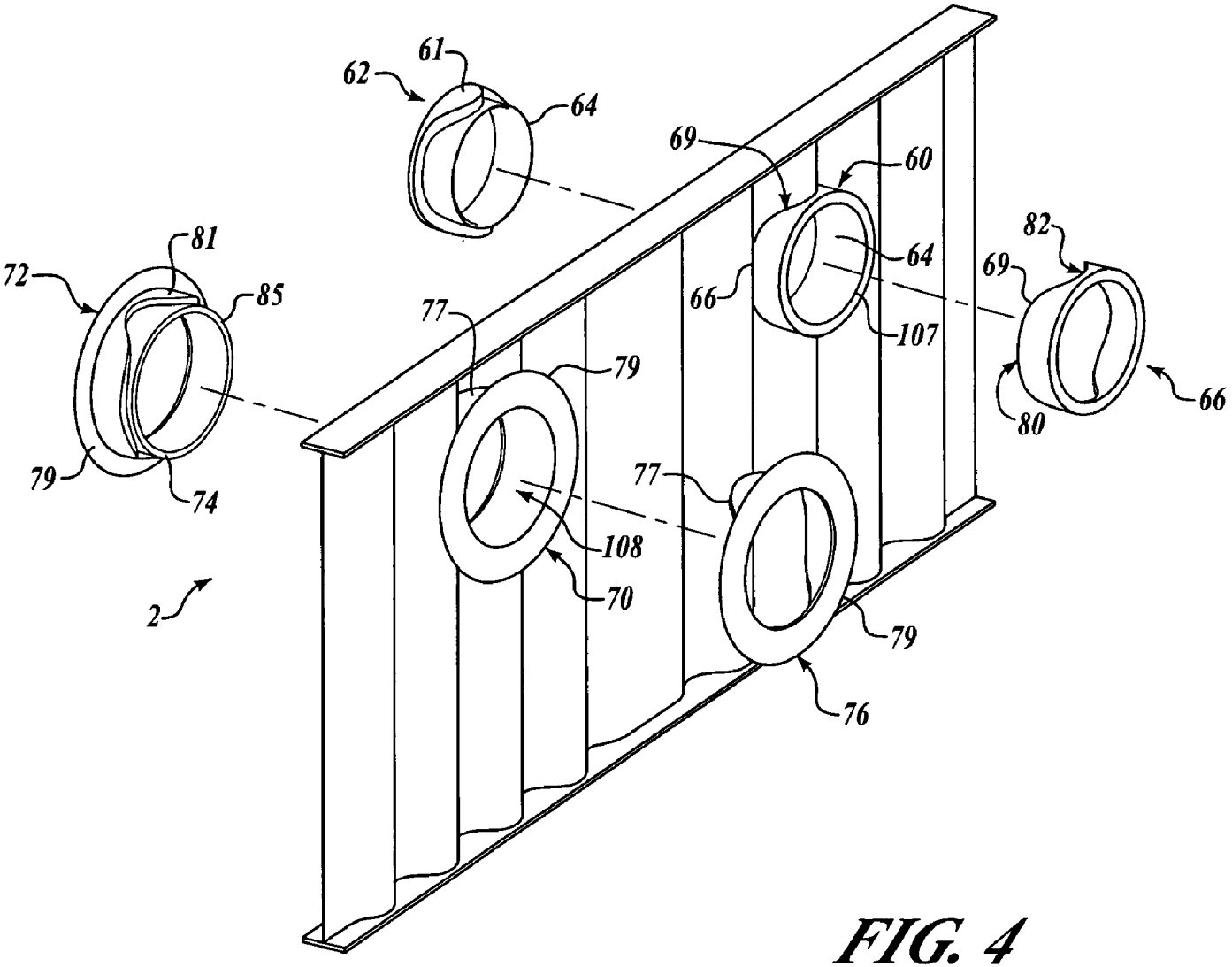
FIG. 4 is an isometric view of an exemplary two-part web reinforcement device according to an embodiment of the present invention.

FIG. 4 is an isometric drawing of a beam 2 with a corrugated web 4. The example beam 2 has two circular penetrations 107 and 108. The first penetration 107 has installed within it a two-part web reinforcement device 60 of the present invention as described in connection with FIG. 3A above. The second penetration 108 has installed within it a two-part web reinforcement device 70 with reinforcing flanges 79 of the present invention as described in connection with FIG. 3B above. FIG. 4 further includes an exploded isometric view of a set of the component parts of the reinforcement devices 60 and 70 (in the same manner as shown and described in FIGS. 3A and 3B above), not installed, but in alignment with their respective penetrations 107 and 108 (which as noted are shown each with a reinforcement device 60 and 70 installed).

Installed in the first penetration 107 are an insert 62 with a tube 64 and first holder 61 (other than the inside of the tube 64 not visible in the installed position in this view) and a second holder 66, as described in connection with FIG. 3A above. The fingers 80 and indents 82 of the second contour 69 of the second holder 66 correspond to and engage the corrugated web 4 at the first penetration 107 when the insert 62 with the tube 64 and first holder 61 is inserted into the first penetration 107 in the beam 2 from a first side (away from the viewer, not visible in this view) through the corrugated web 4. The second holder 66 is slid over the tube and attached to the tube and the corrugated material 4. The resulting assemblage reinforces the corrugated web 4 continuously around the first penetration 107.

Also shown unassembled, but in alignment with the first penetration 107, are two parts of the device 60—the insert 62 with tube 64 and first holder 65, and a second holder 66, all as described in connection with FIG. 3A, above. The insert 62 is shown aligned to be inserted through the first penetration 107 from the first side of the corrugated web 4 (away from the viewer and not visible in this view) with the tube 64 projecting through the corrugated web 4. The second holder 66 is shown aligned with the first penetration 107, in a position,to be slipped over the projecting tube 64 coming through the first penetration 107. When the second holder 66 is attached to the insert 62 including the first holder 61 and tube 64, the first holder 61 and the second holder 66 correspond to and support the corrugations of the corrugated web 4 around the penetration 107. In this exemplary embodiment, the second contour 69 of the second holder 66 mesh with corrugations in the corrugated web 4 on the side of the corrugated web 4 shown in this view.

Similarly, at the second penetration 108, a two-part web reinforcement device 70 with reinforcing flanges 79, as described in connection with FIG. 3B above, is shown installed in the corrugated web 4 of the beam 2. The flanges 79 of the device 70 reinforce the device 70, and thus reinforce the web 4 in the area around the penetration 108. By way of example but not limitation, the flanges 79 in this embodiment are suitably in the form of two flat discs with center holes corresponding to the penetration size attached to the reinforcement device 70, one on each side of the corrugated web 4. The disc shaped flanges help support the reinforcement device 70 across its circular section.

As described above in connection with FIGS. 3A and 3B, the inserts 62 and 72 may be attached to the corrugated web 4, and/or their corresponding second holders 66 and 76, respectively, with any suitable attachment including thermal contraction, adhesives, brazing, or welding. A suitable configuration of fasteners may also be utilized. In the embodiment shown in FIG. 4, the reinforcing device 60 without a flange and the reinforcing device 70 with flanges 79, both tightly sandwich the corrugated web 4 between their respective first holders 61 and 81 and their respective second holders 66 and 76, continuously, around the perimeter of the penetrations 107 and 108, respectively. Similarly, when installed, the respective tubes 64 and 85 support the inside of the perimeters of the respective penetrations by tending to hold the penetrations in an undeformed circular shape.

Figure 5:
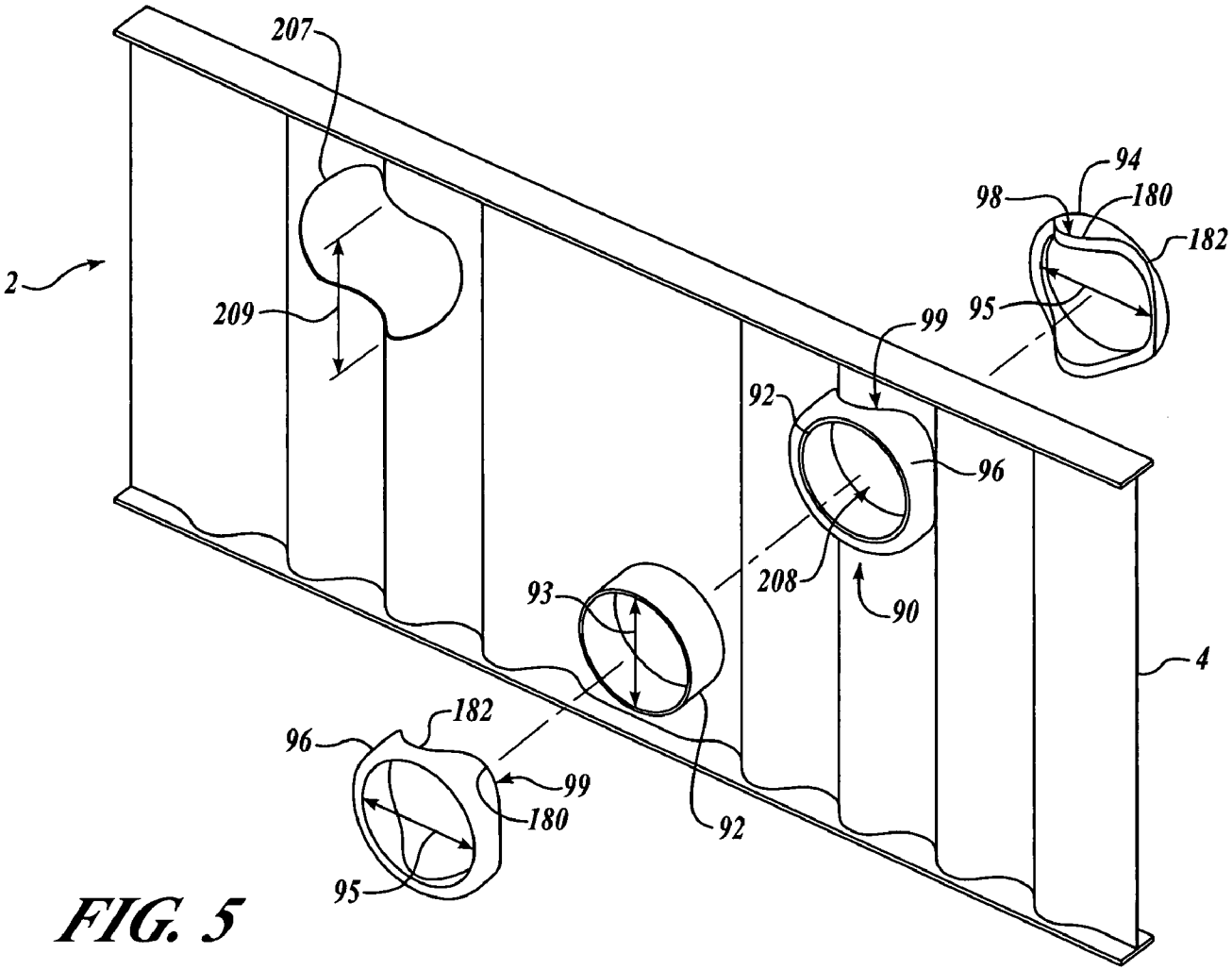
FIG. 5 is an isometric view of an exemplary three-part web reinforcement device installed in a corrugated beam according to an embodiment of the present invention.

It will be appreciated that embodiments of the present invention may be assembled from a variety of independent parts. FIG. 5 shows the installation of a three-part web reinforcement device 90 in a penetration 208 in a corrugated web 4 of a beam 2. An un-reinforced penetration 207 is also shown in the corrugated web 4. While circular in section when viewed from perpendicular to the web 4, it will be appreciated that an un-reinforced penetration 207 appears undulating when viewed from other angles. It is these undulations, i.e., the corrugations, that are supported by at least one finger in the holders attached to the reinforcement devices of the present invention.

In FIG. 5 the web reinforcement device 90 includes a tube 92 with an outside diameter 93 corresponding with the diameter of the penetration 208 in the corrugated web 4. In FIG. 5A a three-part reinforcing device 90 is shown installed, on the web 4, and the three component parts are also shown in exploded isometric view in alignment with the penetration 208.

It will be appreciated that the tube 92 may be received within and reinforce the penetration 208 alone, but without any holder the tube 92 only contacts the inside edge of the corrugated perimeter of the penetration 208. This contact may be welded or brazed when metallic materials are utilized for the web 4 and the tube 92, and adhesive or thermal bonding may also be used. In some applications, it will be appreciated that this butt contact may not provide sufficient area for attachment or adhesion to support corrugations in the web 4, unless holders or retainers 94 and 96 with fingers are used to attach to or sandwich the web 4, and/or to provide additional surface area for adhesives to hold the tube 92 and assembled retainers 94 and 96 in place in the penetration 208.

By way of example but not limitation, the tube 92 is a cylinder with outside diameter 93. The tube 92 is received within the penetration 208, with it ends projecting out each side of the web 4. On the first side of the web 4, the tube 92 is held in place with a retainer 94 that is also cylindrical in cross-section, with an inside diameter 95 corresponding to the outside diameter 93 of the tube 92. Thus the first retainer 94 may slip concentrically over an end of the tube 92 from the first side of the web 4. On the opposite side of the web 4, a second retainer 96, also circular in cross-section, with an inside diameter 95 corresponding to the outside diameter 93 of the tube 92, may be slipped concentrically over the opposite end of the tube 92.

The first retainer 94 has a plurality of fingers 180 and indents 182 that are linked by a contour 98 that corresponds with or matches the corrugations of the first side of the corrugated web 4 (out of view in this FIG. 5) at the penetration 208. The second retainer 96 also has a plurality of fingers 180 and indents 182 linked with and defined by a contour 99 that corresponds with or matches the corrugations in the web on the opposite side (toward the viewer in this FIG. 5). It will be appreciated that when the device 90 is assembled with the first retainer 94 on one side of the web 4, and the second retainer 96 on the opposite side of the web 4, fingers 180 in the first retainer 94 align with and correspond with indents 182 in the second retainer 96 (albeit on opposite sides of the web 4), while indents 182 in the first retainer 94 correspond with fingers 180 in the second retainer 96 on the opposite side of the web. As described in connection with the two-part web reinforcing device 60 of FIG. 3A, it will be appreciated that if the respective contours 98 and 99 of the first retainer 94 and the second retainer 96, respectively, completely correspond and match the corrugations in the web 4 at the location of penetration 208, the corrugations in the web 4 may be completely sandwiched and supported around the perimeter of the penetration 208. This occurs when the first retainer 94 and the second retainer 96 are installed over the tube 92 from opposite ends of the tube 92 received within the penetration 208, from opposite sides of the web 4, and firmly held against the corrugated web 4 in a suitable fashion.

It will be appreciated that any suitable method of attachment may be utilized to attach the first retainer 94 to the tube 92, the second retainer 96 to the tube 92, as well as, if desired, the first retainer 94 to the first side of the corrugated web 4, and the second retainer 96 to the opposite side of the corrugated web 4, and the tube 92 directly to the corrugated web 4. By way of example but not limitation, when metallic materials are utilized, the respective parts may be attached to each other by welding or brazing. Again by way of example but not limitation, in fiber composite parts, suitable adhesives may be utilized. Further, typically in metals due to their coefficients of thermal expansion, suitably sized parts may also be bonded using thermal expansion and contraction. The tube 92 may be cooled before installation of heated retainers 94 and 96. As the retainers 94 and 96 cool, and as the tube 92 warms, the retainers 94 and 96 firmly grip to the tube 92.

The tube 92 may also suitably be bonded to the corrugated web 4 by thermal bonding using thermal expansion and contraction. An interference fit (i.e. thermal bonding through thermal expansion and/or contraction) of the tube 92 outside diameter 93, for example, to the web penetration 207 inside diameter 209 suitably may attach the tube 92 to the web 4. The amount of interference between the tube 92 and the web 4, and as utilized, between the tube 92 and retainers 94 and 96, suitably may be sufficient to prevent the respective parts from lifting away from each other or from the web 4 under anticipated web 4 shear loads. In this way, web 4 shear loads are transmitted through the reinforcement as if the web 4 did not have a penetration. It will be appreciated that where thermal bonding is utilized between the web 4 and tube 92, and between the tube 92 and retainers 94 and 96, the parts may be suitably held together and to the web without welding, brazing, or adhesive.

It will be appreciated that the parts of the reinforcing devices, in all embodiments, may suitably be sized to prevent distortion of the web penetration and to carry induced loads placed on these parts from the web 4, without failure.

It will be appreciated that the three-part web reinforcement device 90 of FIG. 5 may be assembled from two segments of nested tubing. An inner segment of tubing forms the tube 92 with an outside diameter 93 matching the inside diameter of the penetration 208. The outer segment of tubing suitably has an inside diameter 95 corresponding to the outside diameter 93 of the tube 92, allowing it to slip over the inner tube 92. If the outer tube (not shown) is cut in an undulating fashion corresponding with the corrugations in the corrugated web at the penetration 208 in the corrugated web 4, it will be appreciated that the outer tube then becomes two parts. One part forms the first retainer 94 with a contour 98 matching one side of the corrugated web 4, and the other part forms a second retainer 96 with a contour 99 matching the opposite side of the corrugated web 4. Thus, the three-part web reinforcement device 90 as shown in FIG. 5 of this invention may be manufactured using a method of cutting the outer of two nested tubes in an undulating fashion crossways, thereby creating first and second retainers 94 and 96. The inner sized nesting tube 92 is inserted into a penetration in corrugated material. The two pieces of the outer tube, now severed from each other and forming retainers 94 and 96, are slid over opposite ends of the tube 92 as they project from the penetration. Fastening the two pieces of outer tube, i.e., the first and second retainers 94 and 95, to the inner tube 92 and/or opposite sides of the corrugated material reinforces the corrugated web at the location of the penetration.

Figure 6:
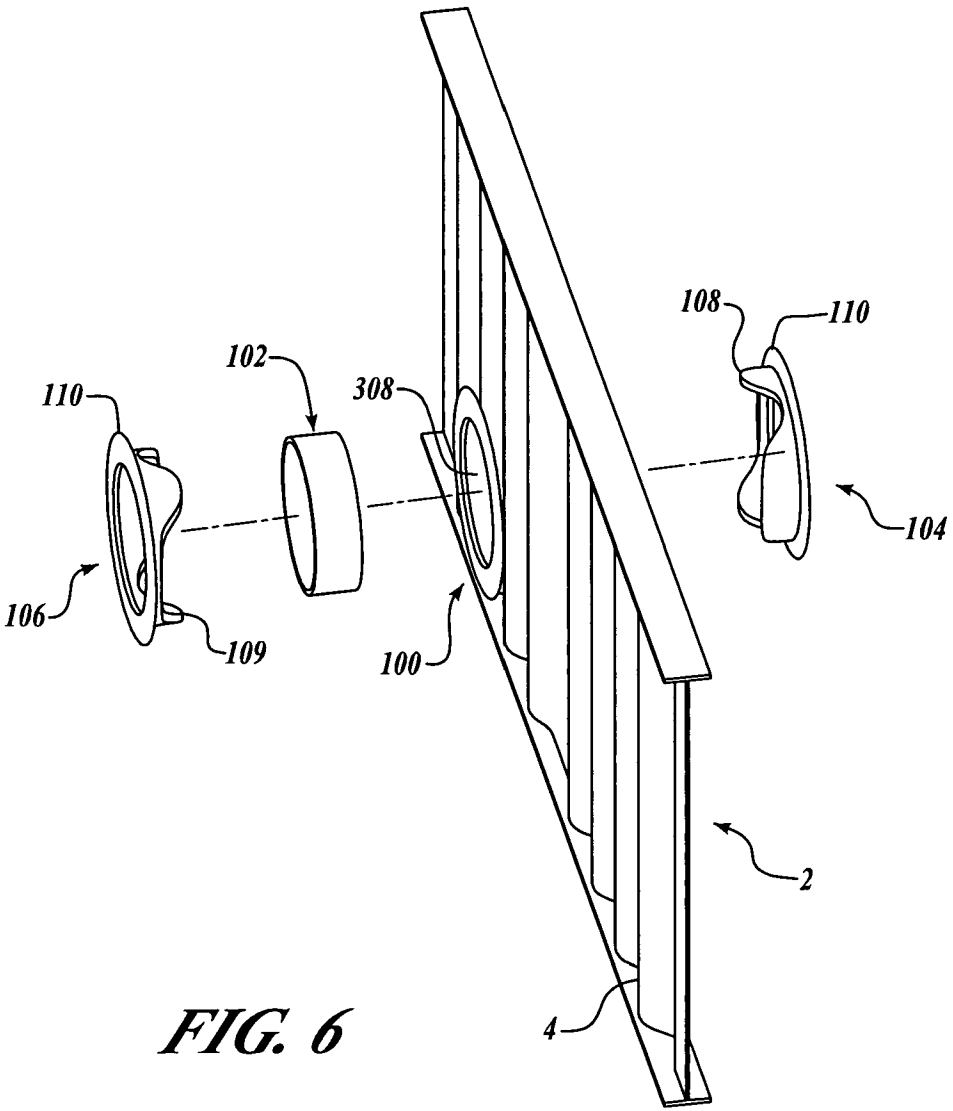
FIG. 6 is an isometric view of an exemplary three-part web reinforcement device with flanges installed in a corrugated beam according to an embodiment of the present invention.

It will be appreciated that the three-part web reinforcement device 90 of the instant invention described in FIG. 5 may also be reinforced with reinforcing flanges. strengthening the device across the penetration. FIG. 6 shows two three-part reinforcing devices 100 with reinforcing flanges 110, one installed in a penetration 308 in a corrugated web 4 of a beam 2, and one in exploded view in alignment with the penetration 308. In this exemplary embodiment, the device 100 includes a tube 102, a first retainer 104 with a contour 108 matching one side of the corrugated web at the penetration 308, and a second retainer 106 with a contour 109 matching the opposite side of the corrugated web 4 at the penetration 308. Both the first retainer 104 and the second retainer 106 include reinforcing flanges that stiffen each retainer in cross-section. In this exemplary embodiment, the tube 102 is cylindrical with a circular cross-section, and the first retainer 104 and the second retainer 106 are sized to slide over the tube from opposite sides of the web 4 receiving the tube 102 and engaging the corrugations of the corrugated web 4, in the same manner as described in connection with FIG. 5. The first contour 108 and the second contour 109 have fingers and indents (not separately called out) that match opposite sides of the corrugated web 4 at the penetration 308, and thus completely sandwich and support the corrugated web 4 laterally around the perimeter of the penetration 308. In turn, the first retainer 104, the tube 102, and the second retainer 106 are reinforced across their cross-sections by the two flanges 110, one attached to the first retainer 104 and the other attached to a second retainer 106. The flanges in this exemplary embodiment are flat rings or discs attached to the retainers reinforcing them across their diameter.

It will be appreciated that the present invention may be utilized to sandwich and support corrugated materials at penetrations. This method, as noted above, reinforces the penetration. This method suitably may also be utilized to repair damaged areas in corrugated material. In the event of punctures or damage to a corrugated material, the damaged area may suitably be excised. A device of the invention may then be inserted in the resulting hole to strengthen the corrugated material at the location of the now deliberately sized penetration. If only one side of the corrugated material is accessible, a single tube with a single holder may be inserted from the accessible side, and attached to the corrugated material, reinforcing the material at that location. If both sides of the corrugated material are accessible, retainers or holders may be utilized from both sides of the corrugated material to sandwich the corrugated material at the perimeter of the penetration while the inside edge of the penetration is supported by the tube inserted through the penetration. It will be appreciated that any suitable material that may be attached to the corrugated material or may hold against the corrugated material may be utilized as inserts and/or retainers for such a repair.

It will be appreciated that penetrations of any size or cross-section may be reinforced using the device and method of the present invention, provided a tube may be received by the corrugated material. Further reinforcement is gained when at least one finger engages the corrugated material around a penetration. Such reinforcement may be installed at any location within the corrugated material, without the aid of any installed flat area to receive the reinforcement. Thus the method and device of the present invention permits penetrations to be installed in corrugated materials at any desired location after manufacture, including where an appropriate holder is configured to correspond with at least part of a corrugation of the corrugated material at the penetration.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A device for reinforcing a penetration in corrugated material, the corrugated material having a first side and a second side and having a plurality of corrugations, the device comprising:

a tube having a first end and a second end, and having an outside perimeter, the tube configured to be received within the penetration;

a first holder attached to the tube, the first holder having a first contour substantially conforming to the first side of the corrugated material around substantially the entire outside perimeter at the penetration and arranged to engage at least one corrugation on the first side of the corrugated material; and a second holder attached to the tube, the second holder having a second contour substantially conforming to the second side of the corrugated material around substantially the entire outside perimeter at the penetration and arranged to engage at least one corrugation on the second side of the corrugated material.

2. The device of claim 1 wherein substantially conforming to the first side of the corrugated material around substantially the entire outside perimeter at the penetration includes completely and continuously engaging the corrugated material around the outside perimeter.

3. The device of claim 2 wherein substantially conforming to the second side of the corrugated material around substantially the entire outside perimeter at the penetration includes rigidly, and completely and continuously, engaging the corrugated material around the outside perimeter.

4. The device of claim 1, further comprising a flat ring flange attached to and extending from the first end of the tube, the flange being arranged to reinforce the tube across a cross section of the tube.

5. The device of claim 1, further comprising a first flange attached to and extending from the first end of the tube and a second flange attached to and extending from the second end of the tube, the first flange and the second flange being arranged to reinforce the tube across a cross section of the tube.

6. The device of claim 1, wherein the tube being is sized to be thermally bonded within the penetration to the corrugated material.

7. The device of claim 1, wherein the second holder is sized to be attached to the tube by thermal bonding.

8. The device of claim 1, wherein the second holder is attached to the tube with an adhesive.

9. The device of claim 1, wherein the first holder and the second holder sandwich the at least one corrugation between the first holder and the second holder engaging the corrugated material around substantially all of the outside perimeter.

10. A device for reinforcing a penetration in corrugated material, the corrugated material having a first side and a second side and having a plurality of corrugations, the device comprising:

an insert including a first section and a second section, the first section being attached to the second section, the first section configured to be received by and to project from the first side to the second side of the corrugated material through the penetration, the first section having an outside cross-section and an outside dimension such that the first section is arranged to fit through and substantially conform with an inside shape and inside dimension of the penetration, the second section including a first holder with a first contour substantially and rigidly conforming to the first side of the corrugated material at the penetration around substantially the entire outside cross-section at the penetration, the contour being arranged to reinforce the first side of the corrugated material; and a retainer arranged to attach to the first section projecting through the penetration, the retainer including a holder defining a second contour substantially and rigidly conforming to the second side of the corrugated material at the penetration around substantially the entire outside cross-section at the penetration, the contour being arranged to reinforce the second side of the corrugated material.

11. The device of claim 10, wherein the first section being arranged to fit through and substantially conform with an inside shape and inside dimension of the penetration includes the first section sized to be thermally bonded to the corrugated material within the penetration.

12. The device of claim 10 wherein the retainer sized to attach to the first section by thermal bonding.

13. The device of claim 10 wherein the retainer is attached to the first section with an adhesive.

14. The device of claim 10 wherein the retainer is arranged to concentrically surround the first section.

15. The device of claim 10 wherein the retainer is attached to a flat ring flange that is arranged to reinforce the outside cross section.

16. The device of claim 10 wherein the first section is linked to a flat ring flange, and the flange is arranged to reinforce the outside cross section.

17. A device for reinforcing a penetration in corrugated material, the corrugated material having a plurality of corrugations and a first side and a second side, the device comprising:

a tube having an outside cross-section and a first end and a second end, the outside cross-section being arranged to fit within and substantially conform with an inside shape of the penetration when the tube is received within the penetration and the first end projects out the first side and the second end projects out the opposite side;

a first retainer attachable to the first end and configured to concentricly surround the first end, the first retainer substantially conforming to the first side of at least part of a corrugation at the penetration, the first contour being arranged to reinforce the at least part of a corrugation; and a second retainer attachable to the second end and configured to concentricly surround the second end, the second retainer having a second contour substantially conforming to the second side of the at least part of a corrugation, the second contour being arranged to reinforce the at least part of a corrugation, wherein at least one of the first and second retainers is attached to a flat ring flange that is arranged to reinforce the tube.

18. The device of claim 17 wherein the cross section includes a circular cross section.

19. The device of claim 17 wherein the first retainer and the second retainer sandwich the at least part of a corrugation between the first retainer and the second retainer substantially around the entire cross-section of the tube.

20. The device of claim 17 wherein the first retainer is attached to a first flange and the second retainer is attached to a second flange, the first and second flanges being arranged to reinforce the tube substantially around the entire cross-section.

21. The device of claim 17 wherein the first retainer is attached to the tube by thermal bonding.

22. The device of claim 17 wherein the first retainer is attached to the tube with adhesive.

23. The device of claim 17 wherein the first retainer is attached to the tube with an attachment method including one of brazing and welding.

24. The device of claim 17 wherein the second retainer is attached to the tube by thermal bonding.

25. The device of claim 17 wherein the second retainer is attached to the tube with adhesive.

26. The device of claim 17 wherein the second retainer is attached to the tube with an attachment method including one of brazing and welding.

27. The device of claim 17 wherein the outside cross-section being arranged to fit within and substantially conform with an inside shape of the penetration includes the outside cross-section sized to be thermally bonded to the corrugated material.

* * * * *